United States Patent [19]

Stone-Parker et al.

[11] Patent Number: 4,842,157

[45] Date of Patent: Jun. 27, 1989

[54] RETAINER FOR DRINKING CONTAINER

[76] Inventors: Elaine W. Stone-Parker; John J. Stone-Parker, both of 1971 Spear St., South Burlington, Vt. 05403

[21] Appl. No.: 92,941

[22] Filed: Sep. 4, 1987

[51] Int. Cl.[4] ..... A47G 19/22

[52] U.S. Cl. ..... 220/90.4; 220/90.2; 229/1.5 B

[58] Field of Search ..... 220/90.4, 90.2, 90.6; 229/1.5 B; 222/547, 564, 569, 189; 210/464

[56] References Cited

U.S. PATENT DOCUMENTS

| | | | |
|---|---|---|---|
| 1,739,627 | 12/1929 | Austin | 220/90.4 |
| 2,217,833 | 10/1940 | Chapman | 220/90.2 X |
| 2,529,114 | 11/1950 | Tellier | 220/90.4 |
| 3,040,897 | 6/1962 | Holman | 210/464 X |
| 3,313,447 | 4/1967 | Spencer | 220/90.4 |
| 3,797,696 | 3/1974 | Dibrell | 220/90.4 |
| 4,602,557 | 7/1986 | Yip | 229/1.5 B |

*Primary Examiner*—Steven M. Pollard

*Attorney, Agent, or Firm*—Larson and Taylor

[57] ABSTRACT

A drinking container has a retainer device to retain relatively large objects such as ice cubes therebeneath. The retainer device has a central portion which may contain printed indicia and a plurality of resilient arms extending radially outwardly to resiliently engage the container. A porous pouch adapted to receive an additive for release of an ingredient into the liquid may be mounted to the bottom of the central portion.

16 Claims, 2 Drawing Sheets

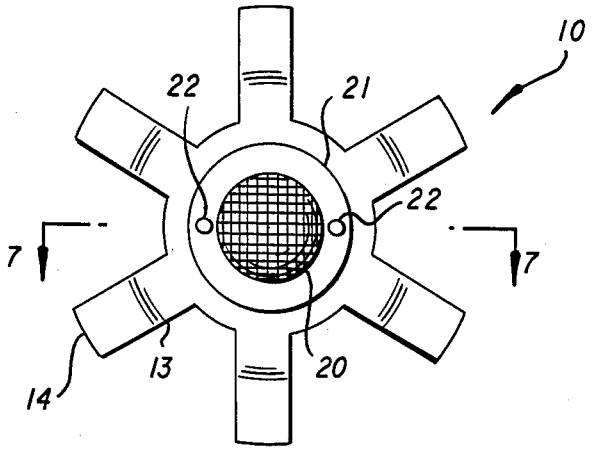
FIG. 6
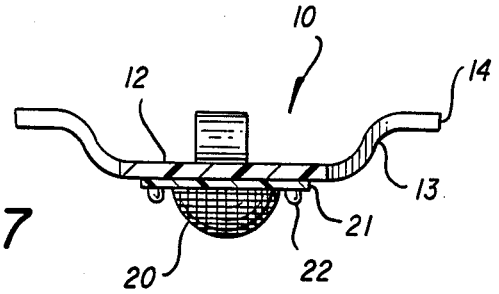
FIG. 7
FIG. 8
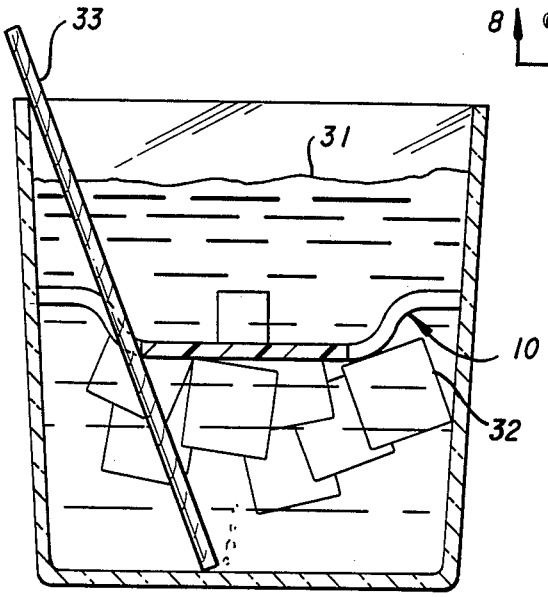
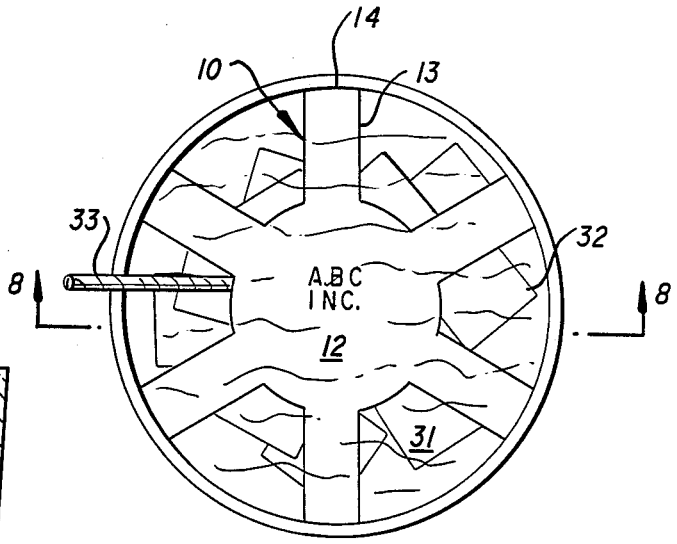
FIG. 9

RETAINER FOR DRINKING CONTAINER

FIELD OF THE INVENTION

This invention relates to improvements in drinking containers, and more specifically it relates to new and improved arrangements for retaining solid objects in a liquid within such a container.

BACKGROUND OF THE INVENTION

Liquids in a drinking container such as a glass or a plastic or paper cup or the like often contain solid objects such as ice, lemon or lime slices, olives, etc. which, during normal drinking, may disrupt the smooth flow of the liquid, causing sudden and awkward spilling of the contents onto the face and clothing of the user.

Devices known heretofore for dealing with these problems are shown for example in the following prior U.S. Pat. Nos.: Swing, U.S. Pat. No. 2,357,063; Toombs, U.S. Pat. No. 2,744,631; Gaines et al, U.S. Pat. No. 2,753,049; Lerner, U.S. Pat. No. 3,549,044; Addington, U.S. Pat. No. 3,940,012 and Lichter, U.S. Pat. No. 4,020,532.

However, these prior art devices suffer from many disadvantages. All of them are generally of a single fixed size, thus precluding adaptability of a single device to a plurality of different sizes and shapes of drinking containers and/or to different levels within a given container. The adaptability of the prior devices is also minimized or negated by their mounting structures which are generally cumbersome and often require interaction and hence also interference with the top or bottom of the container. Such interaction also presents the danger of cracking or breaking the container. Moreover, all of these devices except that shown in Gaines et al are similar or analogous to a strainer in that they substantially and/or uniformly cover the area across the container, leaving relatively small openings for the flow of liquid therethrough. This arrangement is aesthetically inferior in that it creates a mental barrier between the user and the liquid contents and prevents the free flow of and access, e.g., to the liquid to stir the same or to add new solid ingredients or the like. These strainer like devices also suffer from the disadvantage that they are of relatively complex shapes, thereby making them expensive to manufacture and difficult to clean for possible reuse.

Moreover, these prior devices do not address the special problem of positioning an additive such as tea, medication or the like within the liquid for the release of ingredients into the liquid.

Thus, there exists a need for a new and improved retainer for a drinking container which overcomes the problems inherent in the prior devices.

SUMMARY OF THE INVENTION

It is a purpose of the present invention to provide a new and improved retainer for a drinking container which provides new and advantageous results and overcomes the disadvantages of the previously known retainer devices.

This purpose is achieved, in accordance with the present invention, by providing a relatively simplistic, but yet highly effective and advantageous retainer device which comprises a central portion and a plurality of resilient arms extending radially outwardly therefrom. These arms engage the inside walls of the container to secure the retainer in place at any desired vertical location within the container; and because of their specific characteristics, including their resiliency, a given device is adaptable to different container inside diameters over a relatively wide range.

In a preferred arrangement, the retainer of the present invention comprises a relatively large central portion which provides an area for advertising messages or any other indicia such as ornamental characters, etc. The number of radial arms extending outwardly from this central portion can be as few as three (which would be required in order to secure the device within the retainer) or as many as desired, depending on aesthetics, the size and shape of a given container, the desired degree of adaptability of the retainer to different sizes and the desired size of the openings between the arms. A preferred number of arms would be in the range of five to eight. The resiliency of the arms can be derived from a combination of factors including the nature of the selected material, preferably plastic, and the specific shape of the individual arms. For example, in a preferred arrangement, the arms will include a double bend, first upwardly and then outwardly, such that the arms can yield within a given range in a radial direction to adapt the retainer device to different diameters.

The integrity of the engagement of the arms with the inside wall of the container can also be assured in different ways. For example, the outer edge of the arms can be inclined downwardly at a slight angle and/or the outer edge of the arms can be covered or formed with a rubber tip in order to enhance frictional engagement between the arms and the inside wall of the container. The rubber tip might be more appropriate for a glass or plastic container while an untipped arm might be more appropriate for a paper cup.

Another advantage of the retainer device of the present invention is that it provides relatively large openings around the perimeter of the device which may be small enough to retain the solid objects such as ice cubes, slices of fruit, olives or the like, and yet large enough to assure a desired ambience in that the user can still see the contents directly rather than through the small claustrophobic openings of a strainer or the like. This is important in that it gives the user the feeling that he or she is drinking the actual liquid and not a strained modification thereof; and the user still has free access to the liquid contents for purposes of adding ingredients such as sugar or the like or inserting a stirrer and physically stirring the contents. Another advantage of the present invention is its vertical adaptability which permits the user to place the restrainer device at any desired vertical height, for example at the surface or if desired far beneath the surface. If the liquid is opaque or the retainer is relatively transparent, placement of the retainer far below the surface could render it essentially out of sight to the user.

Another preferred feature of the present invention is the provision of a porous pouch which may be removably or permanently fixed to the bottom of the central portion in order to place a selected object or material into the liquid itself. The uses of such a pouch are innumerable. For example, one can add flavoring materials such as lemon slices, tea leaves, a tea bag, dissolvable tablets or flavoring agents or medication which is to be dissolved into the liquid. Additionally, the retainer device can be used as a child's toy, for example,in a milk glass, with a surprise toy or the like located in the pouch for removal as an incentive after a child has finished his or her milk.

Thus, it is a purpose of the present invention to provide a new and improved retainer device for a drinking container.

It is another object of the present invention to provide a new and improved retainer for retaining solid objects in a drinking container, which has a central portion and resilient arms extending outwardly therefrom for engagement with the inside wall of the drinking container.

It is still another object of the present invention to provide a new and improved retainer device of the type described which is adaptable to be positioned at different heights within a given container and/or in different size containers.

It is still another object of the present invention to provide a retainer device of the type described which has a central portion suitable for printed material or the like.

It is still another object of the present invention to provide a new and improved retainer device for retaining solid contents within a drinking container, which device has relatively large openings for the free flow of the liquid and for free access to the liquid beneath the retainer device.

It is still another object of the present invention to provide a retainer device in combination with a porous pouch for locating a solid object or materials within the liquid of the container.

It is still another object of the present invention to provide a means positionable across a drinking container for locating a porous pouch within the drinking container for receiving solid materials, preferably materials which dissolve or release an ingredient into the liquid.

These and other objects of the present invention will become apparent from the detailed description to follow.

BRIEF DESCRIPTION OF THE DRAWINGS

There follows a detailed description of preferred embodiments of the present invention, which will be read together with the accompanying drawings wherein:

FIG. 6 is a bottom plan view of the retainer device of the present invention, showing a modification.

FIG. 7 is a cross-sectional view, taken along line 7—7 of FIG. 6.

FIG. 8 is a cross-sectional view of a drinking container showing the present invention in use, and taken along line 8—8 of FIG. 9.

FIG. 9 is a top plan view of FIG. 8.

DETAILED DESCRIPTION OF THE PREFERRED EMBODIMENTS

Referring now to the figures, like elements represent like numerals throughout the several views.

Figure 1:
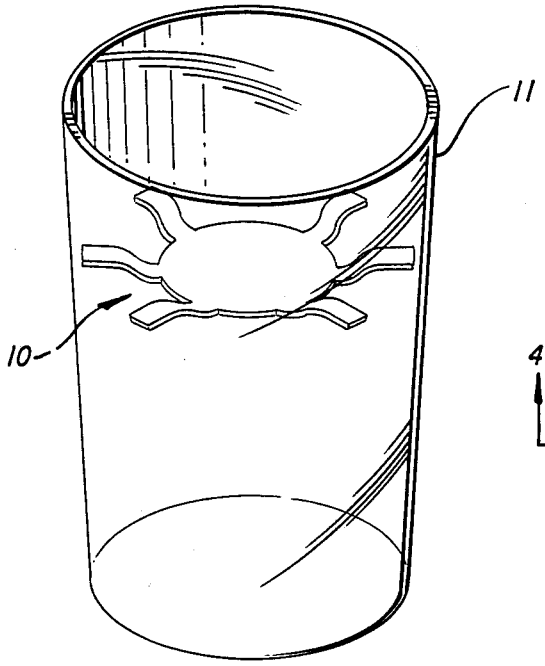
FIG. 1 is a schematic perspective view of a drinking container with a retainer device of the present invention mounted therein.

FIG. 1 illustrates schematically a retainer device 10 mounted within a drinking container 11. Container 11 may be any kind of drinking container including a glass, a plastic or ceramic cup or a paper cup or the like. As discussed below, it is a feature of the present invention that a given retainer device 10 can be adapted for use in different size and shape containers and also at different heights within a given container. The retainer device 10 is also shown in use in FIGS. 8 and 9 which will be discussed in greater detail below.

Figure 3:
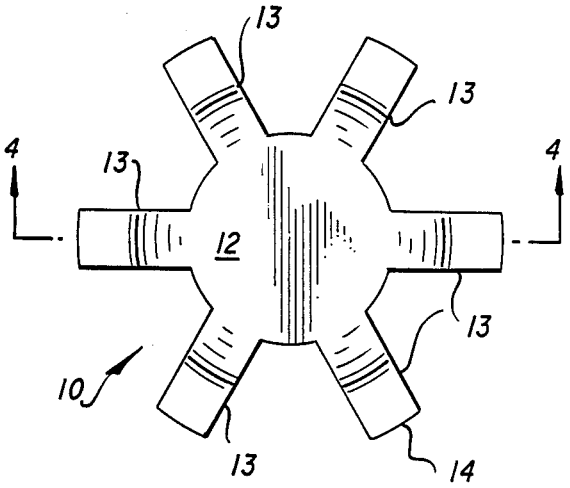
FIG. 3 is a plan view of FIG. 2.
Figure 2:
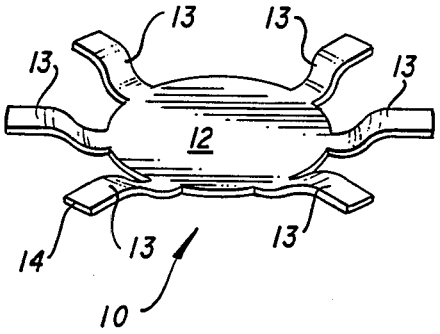
FIG. 2 is an enlarged perspective view of the retainer device of FIG. 1.
Figure 4:
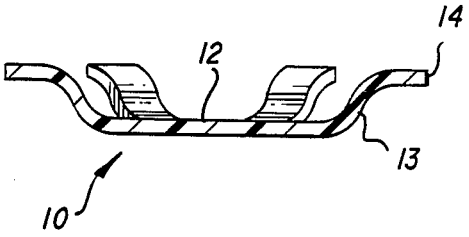
FIG. 4 is a cross-sectional view, taken along line 4—4 of FIG. 3.

Referring to FIGS. 2 through 4 the retainer device 10 comprises a solid central portion 12 and a plurality of arms 13 extending radially outwardly therefrom, each terminating at an outer end 14. The central portion 12 serves as the basic body portion of the retainer device 10. In addition thereto, it provides a solid area for printing, including for example advertisements, ornamentation, instructions, etc. The arms 13 are designed with sufficient resiliency to exert an outward force on the inside wall of a drinking container so as to hold the retainer device 10 in place. The specific degree of resilience of the arms 13 depends upon the resiliency of the material used to make the retainer device 10, the thickness of the arms 13, the length of the arms 13 and their configuration. In the illustrated embodiment six arms are provided. In practice, the number of arms can be a minimum of three and any maximum, as is practical in a given container. In this embodiment the arms have a general "S" shape, first turning up and then outwardly. This allows the arms to be pushed inwardly to a considerable extent in order to fit within a drinking container of a relatively small diameter. The largest possible diameter to which the device 10 of FIGS. 1 through 4 would adapt would be an internal diameter slightly less than the diameter of a circle formed by outer edges 14, as viewed in FIG. 3, so that each of the arms could be pushed back just slightly so as to exert a resilient holding foce against the inside wall of the container.

By selecting the various parameters, as described above, any given retainer device 10 can be made operable over a relatively wide range of diameters. This ability to be operable over a wide range of diameters also allows a retainer device 10 to be operable at different heights within a given container, even though the container may taper inwardly and downwardly, as is the case for example with many glasses, paper and plastic cups and the like. For example, in one application the user may wish to have the retainer device 10 located near the top, near the original surface of the drinking container; whereas in another application it may be desirable to place the retainer device 10 relatively far down into the drinking container, submerged well below the normal, original surface of the liquid. The ends 14 of the arms 13 can have any suitable construction, so long as they will frictionally engage the inside wall of the drinking container.

Figure 5A:
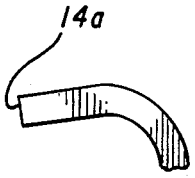
FIG. 5A is a partial view of the retainer of the present invention, showing a detail.
Figure 5B:
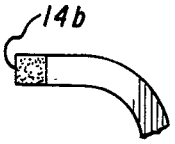
FIG. 5B is another partial view of the invention, showing a modification.

Some special forms of the ends 14 are shown in FIGS. 5A and 5B. In FIG. 5A the end **14*a* is formed with a slight downward, inward angle. This would be most suitable for use in a paper cup. For surfaces which might be more difficult to frictionally engage, such as glass, plastic or a ceramic surface, the ends 14 may be provided with a rubber tip as shown in FIG. 5B at 14*b***.

FIGS. 1 through 5, as discussed above concerns that portion of the present invention intended essentially to restrain relatively large objects such as ice, slices of fruit, olives or the like for moving upwardly toward the top of the container, so that such objects will not interfere with the smooth flow of liquid as the user drinks from the container. The user may also wish to use the large openings to introduce ingredients such as cream or sugar into the liquid or to insert a stirring device or the like. It is an advantageous feature of the present invention that the spaces formed between adjacent arms and further defined by the outer rim of the central portion and the inside wall of the glass will be large enough for such smooth flow and for the introduction of such materials. In addition, these large areas provide the significant advantage that the user feels that he or she is drinking the contents of the drinking container directly, and not through a strainer. The size of these openings will depend upon the nature of the solid objects which the retainer device is designed to restrain, the desired maximum diameter of the central portion (for advertisements, ornamentation or the like) the length and hence the resilience of the arms 13 and the thickness and number of arms 13. In summary, all of these factors are designed to provide an optimum, in any given case, between the resilient characteristics of the device and the size of the openings.

FIGS. 6 and 7 illustrated a modification of the present invention. As illustrated therein, a porous pouch 20, for example a one-piece mesh strainer pouch, mounted on a flange 21 can be connected to the bottom of the central portion 12. Preferably, the pouch is removably connected so that it can be removed for the introduction and removal of contents. In the illustrated embodiment, the flange 21 has a pair of openings which removably snap onto snap retaining pins 22. This pouch could be used, for example, to hold flavoring such as lemon slices, tea leaves, a tea bag, dissolvable tablets or flavoring agents or the like. Or, the pouch can be used for medications such as pills and the like which could dissolve into the liquid. In still another use, the pouch could contain a surprise toy which would be the reward for a child after having finished drinking a glass of milk in which a retainer device of the present invention was originally submerged.

FIGS. 8 and 9 illustrate the basic embodiment of FIG. 1 through 4, in use in a drinking container 30 filled with a liquid 31 and wherein the retaining device 10 is retaining ice cubes 32. In this particular embodiment, it was desired to place the retainer device 10 well below the surface 31 of the liquid. One of the openings is used in this example for receiving a stirrer 33. Referring to FIG. 9, the solid central portion 12 carries printed indicia.

Although the invention has been described in considerable detail with respect to preferred embodiments thereof, it will be apparent that the invention is capable of numerous modifications and variations, without departing from the spirit and scope of the invention, as set forth in the claims.

We claim:

1. In combination, a drinking container having generally upright sides and a retainer device therefor, said device extending generally horizontally across the container and comprising a solid central portion and at least three resilient arms extending radially outwardly from the central portion, said central portion located at the center of the container, and said resilient arms extending radially outwardly from the central portion into engagement with the inside wall of the container, said arms resiliently engaging the inside wall of the container so as to retain the device in the container in a generally horizontal orientation, extending across the inside of the container at a height between the bottom and the top of the container, the resiliency of the arms being sufficient to allow them to retain the device over a limited range of inside diameters of the container, the central portion having a diameter between the arms of no more than 75 percent of the diameter of a circle formed by the outer tips of the resilient arms, and the arms themselves being sufficiently spaced apart that the space formed between adjacent arms, an adjacent edge of the central portion and an adjacent portion of the inside wall is small enough to retain relatively large objects such as ice cubes and the like when the container is tilted for drinking or pouring of its liquid contents and large enough to allow the free flow of liquid therethrough.

2. The invention of claim 1, said central portion having printed indicia thereon.

3. The invention of claim 1, said central portion being generally flat and horizontal, and said arms extending outwardly, upwardly and again outwardly into engagement with the container.

4. The invention of claim 1, the outer ends of the arms which engage the container being formed at a slight angle downwardly and inwardly.

5. The invention of claim 1, including rubber tips on the outer ends of the arms.

6. The invention of claim 1, including a porous pouch mounted on the bottom of said central portion.

7. The invention of claim 6, said pouch being removably mounted to the bottom of said central portion.

8. In combination, a drinking container having generally upright sides and a means for mounting an additive for release of an ingredient into a liquid in the container, said means comprising a retainer device extending generally horizontally across the container, said device having a solid central portion located at the center of the container and at least three resilient arms extending radially outwardly from the central portion and resiliently engaging the inside walls of the container the resiliency of the arms being sufficient to allow them to retain the device over a limited range of inside diameters of the container, the central portion having a diameter between the arms of no more than 75 percent of the diameter of a circle formed by the outer tips of the resilient arms, and a porous pouch mounted to the bottom of the central portion for containing the additive.

9. The invention of claim 8, wherein the pouch is removably attached to the retainer device.

10. A solids retaining device adapted to be inserted into a drinking container of the type having generally upright sides, comprising:

a solid central part, at least three resilient arms of generally equal length extending radially outwardly from the central part, the outer tips of the resilient arms constructed to be able to frictionally engage an inside wall of a container the resiliency of the arms being sufficient to allow them to retain the device over a limited range of inside diameters of a container, the central portion having a diameter between the arms of no more than 75 percent of the diameter of a circle formed by the outer tips of the resilient arms, and wherein the arms themselves are sufficiently spaced apart that the spaces bounded by adjacent arms, the outer periphery of the central part and a circle passing through the outer tips of all of the arms are small enough to prevent relatively large objects such as ice cubes and the like from passing therethrough when the device is placed in a container and the container is tilted for drinking or pouring of its liquid contents, and such spaces are large enough to allow the free flow of liquid therethrough.

11. The invention of claim 10, said central portion having printed indicia thereon.

12. The invention of claim 10, said central portion being generally flat and horizontal, and said arms extending outwardly, upwardly and again outwardly.

13. The invention of claim 10, the outer ends of the arms which are adapted to engage the container being formed at a slight angle downwardly and inwardly.

14. The invention of claim 10, including rubber tips on the outer ends of the arms.

15. The invention of claim 10, including a porous pouch mounted on the bottom of said central portion.

16. The invention of claim 15, said pouch being removably mounted to the bottom of said central portion.

* * * * *

UNITED STATES PATENT AND TRADEMARK OFFICE

CERTIFICATE OF CORRECTION

PATENT NO. : 4,842,157

DATED : June 27, 1989

INVENTOR(S) : STONE-PARKER, et al

It is certified that error appears in the above-identified patent and that said Letters Patent is hereby corrected as shown below:

Please correct the front page of the above identified patent by correcting the inventor names to read as follows:

[76] Inventors: Elaine W. Stone-Parker; John J. Stone Parker, both of 1971 Spear St., South Burlington, VT 05403

Signed and Sealed this

Seventeenth Day of April, 1990

*Attest:*

HARRY F. MANBECK, JR.

*Attesting Officer*

*Commissioner of Patents and Trademarks*